US005915478A

United States Patent [19]

Brown et al.

[11] Patent Number: 5,915,478

[45] Date of Patent: Jun. 29, 1999

[54] HYDROSTATIC STANDING VALVE

[76] Inventors: Henry F. Brown, 2326 Heritage Trail; Jeffrey J. Brown, 5809 Cedar Ridge, both of Enid, Okla. 73073

[21] Appl. No.: 09/014,845

[22] Filed: Jan. 28, 1998

[51] Int. Cl.[6] ..... E21B 34/08

[52] U.S. Cl. ..... 166/329; 166/372

[58] Field of Search ..... 166/325, 329, 166/372; 137/515

[56] References Cited

U.S. PATENT DOCUMENTS

| | | | |
|---|---|---|---|
| 3,450,206 | 6/1969 | Natkins | 166/329 |
| 3,580,697 | 5/1971 | Youngblood . | |
| 3,603,394 | 9/1971 | Raulins | 166/325 |
| 3,901,315 | 8/1975 | Parker et al. | 166/321 |
| 3,968,839 | 7/1976 | Swihart, Sr. | 166/250.07 |
| 4,007,784 | 2/1977 | Watson et al. . | |
| 4,243,361 | 1/1981 | Groff . | |
| 4,354,554 | 10/1982 | Calhoun et al. . | |
| 4,410,300 | 10/1983 | Yerian . | |
| 4,465,435 | 8/1984 | Copas . | |
| 4,691,735 | 9/1987 | Horton . | |
| 4,867,242 | 9/1989 | Hart | 166/369 |
| 5,139,398 | 8/1992 | Downing | 417/511 |
| 5,642,900 | 7/1997 | Short | 417/444 |

*Primary Examiner*—George Suchfield
*Attorney, Agent, or Firm*—Crowe & Dunley

[57] ABSTRACT

An improved standing valve which regulates the amount of accumulated fluid in the tubing string of an oil and gas well, to an amount that is within the purging capability of the gas-lift method. The present invention provides a hydrostatic standing valve with a floating valve seat which is displaced in response to the weight of an accumulated fluid head. A ball seals against the floating valve seat and floats with it, but the displacement of the ball is limited by a positive stop provided by a rod supported by the standing valve body. When the valve seat displaces beyond that of the ball, as limited by the positive stop, the ball is sealingly disengaged from the valve seat and fluid flows out of the tubing string. The dynamic response of the spring to the weight of the fluid head regulates the accumulated head to not exceed a predetermined amount so that the fluid head can be predicted and regulated below an amount that can be reliably purged by conventional gas-lift methodologies, either continuous or intermittent.

16 Claims, 3 Drawing Sheets

HYDROSTATIC STANDING VALVE

FIELD OF THE INVENTION

The present invention relates to the field of oil and gas well fluid production from subterranean formations, and more particularly but not by way of limitation, to valves for regulating the fluid head in a tubing string of an oil and gas well to facilitate fluid removal by gas-lift methodologies.

BACKGROUND OF THE INVENTION

Methods of enhancing production from oil and gas wells with lower end productivity indices, such as depletion wells, otherwise known as stripper wells, have continually been developed and improved to make oil and gas resources recoverable that otherwise could not be produced economically. The gas-lift method of fluid purging is one such method that was developed over a decade ago. Through continual refinement, gas-lift methods have been established as a viable means of enhancing oil and gas production.

In a typical oil and gas well, a well bore is created in the earth and a casing is inserted into the well bore. The casing encloses a tubing string which passes through a well head located at the top of the well bore. The casing has a plurality of perforations which are positioned at a selected depth within the subterranean formation and which allow oil and gas to enter the casing near the lower end of the tubing string. The depth of the perforations depends upon the characteristics of the subterranean formation, and generally varies from about 1,000 feet to over 15,000 feet below the earth's surface. The composition of the fluid which enters the casing depends upon the conditions of the subterranean formation and on the particular production techniques employed, but will generally be a mixture of liquid (including oil and water) and gases (including natural gas).

Ideally, pressure from the formation forces fluid through the tubing string to the earth's surface, where a production line delivers the liquid and gas mixture to a separator. A choke valve on the production line variably restricts the fluid flow rate to provide a desirable back pressure in the tubing string. The choke valve is controlled by a conventional controller, which may be responsive to a number of well conditions, such as subterranean pressure (i.e., "bottom-hole" pressure) and casing pressure.

A well with a relatively high bottom-hole pressure and a relatively high productivity index can be operated continuously, in part by controlling the back pressure on the tubing string to produce a gas velocity that effectively carries the liquid up the tubing string to the production line. If the gas velocity is too great, the gas will over-run the liquid in the tubing string and no liquid will be produced. On the other hand, if the gas velocity is too low, then the gas will not have sufficient energy to carry the liquid up the tubing string to the production line.

A gas-lift method is commonly used in a continuously flowing well to enhance production. The gas-lift methodology works by injecting a relatively small volume of high pressure gas, such as air, into the tubing string at some predetermined depth to assist the bottom-hole pressure to carry the fluid in the tubing string to the production line. To inject the required gas, the well is provided with a casing line through which the gas is injected to pressurize the casing. The injected gas enters the tubing string through one or more of a plurality of conventional control valves located along the tubing string. Once injected into the tubing string, the expanding injection gas aerates and lightens the fluid column thereby helping the bottom-hole pressure to deliver the fluid to the production line.

A well with a relatively low bottom-hole pressure and a relatively low productivity index is typically equipped with a conventional standing valve which is placed in the bottom of the tubing string. A conventional standing valve functions simply as a check valve which allows upward flow of fluid from the well bore into the tubing string, but prohibits downward flow of fluid from the tubing string into the well bore. In this manner, the conventional standing valve accumulates fluid in the tubing string.

Removing the fluid which accumulates above the conventional standing valve in the tubing string of a well with a low bottom-hole pressure is problematic because of the diminished pressure and because such a well typically produces higher viscosity oil. A common way to remove the fluid from the tubing string is to operate the well using an intermittent gas-lift method.

Using the intermittent gas-lift method, gas enters the tubing string at a high instantaneous rate for a short period to purge the liquid accumulated in the tubing string as a slug. Thus, the intermittent gas-lift method uses high pressure gas at a sufficient volume and pressure to lift the liquid slug to the production line at a maximum velocity, while minimizing aeration and fluid fall-back. To create the intermittent nature of the purging, the choke valve is periodically closed to build up gas-lift pressure. The gas-lift pressure may come only from the subterranean formation or it may be supplementally injected into the casing. Opening the choke valve after building pressure creates a pressure differential that purges the liquid as a slug as the pressure differential equalizes. Purging the liquid slug at a maximum velocity requires controlling numerous process variables, such as purging frequency, injection pressure, and tubing size. A conventional packer is typically used to minimize the effective volume of casing that must be pressurized.

The efficiency of using an intermittent gas-lift method to lift a slug of fluid leaves much to be desired. Lifting a slug of liquid by the gas-lift method causes the gas to increasingly intermix and channel through the liquid, which aerates the liquid and imparts a velocity profile to it. When gas channels completely through the liquid, the gas imparts turbulence to the liquid. Turbulence is undesirable because it diminishes purging efficiency by causing liquid to fall back within the tubing string.

A common solution to this problem has been to use the gas-lift method in conjunction with a lifting plunger. The lifting plunger is positioned in the tubing string to provide a mechanical barrier between the pressurized gas upstream of the lifting plunger and the liquid slug downstream of the lifting plunger. One skilled in the art will recognize that the use of the lifting plunger in conjunction with the standing valve permits liquid pumping efficiency that is comparable to that of sucker rod pumping, but at a fraction of the cost. To outfit a well with a gas-lift and lifting plunger can typically cost about $4,000, which compares to about $30,000 to outfit a well with a pumpjack.

The method of intermittent purging of the liquid with a plunger and a gas-lift method is like that described previously, except that the pressure differential resulting from opening the choke valve acts across the lifting plunger which, in turn, pushes the accumulated liquid up the tubing string. The plunger can be retained at the top of the tubing string by a conventional lubricator after the plunger has purged the tubing string. One skilled in the art will recognize that following a purge cycle it is preferable to retain the plunger in this manner so that fluid can be continuously produced from the subterranean formation without obstruction in the tubing string by the plunger.

As the well continuously produces, a portion of the liquid carried by the gas falls back within the tubing string. A timer is typically used to anticipate when enough liquid has accumulated to warrant an intermittent purging cycle. To purge the liquid, the choke valve is closed and the plunger is released. To prevent damage to the plunger and the standing valve resulting from the plunger free-fall, a conventional bumper spring is latched to the standing valve to absorb the impact of the returning plunger. The choke valve remains closed long enough to build the desired gas-lift pressure, and then re-opened to purge the liquid.

The benefits of using the lifting plunger are well known by one skilled in the art, including: 1) channeling of gas through the liquid is eliminated, 2) injection ratios per barrel of liquid are considerably lower because of a solid interface between the gas and liquid phases, 3) lower gas-lift pressures can be used because lifting energy is conserved, and 4) continuous wiping action of the plunger against the casing prevents contaminant build-up, such as the build-up of paraffin, salt, and ice.

There are various types of lifting plungers, such as those taught by U.S. Pat. No. 4,007,784 issued to Watson, and U.S. Pat. No. 4,410,300 issued to Yerian. These and other references teach diverse schools of thought in plunger design, ranging from very complicated to very simple construction. At a most general level, lifting plungers are categorized into three basic types: 1) the solid type, 2) the expanding type, and 3) the bypass type.

The conventional standing valve used in combination with the lifting plunger functions simply as a check valve which allows upward flow of fluid from the well bore into the tubing string, but prohibits downward flow of fluid from the tubing string into the well bore. In this manner, the conventional standing valve accumulates a fluid slug in the tubing string.

The conventional standing valve has a body which has a central passageway that provides fluid communication through the valve. A valve seat is supported by the body within the passageway. The valve seat has an annulus that is coaxial with the central axis of the central passageway. A valve ball is supported by the valve seat in one mode wherein the ball sealingly engages against the valve seat and prevents downward flow of fluid through the annulus. In another mode the ball freely lifts upward off the valve seat to permit upward flow of fluid through the annulus. By this construction, one skilled in the art will recognize the conventional check valve construction of the prior art standing valve which permits fluid flow upward through the standing valve from the well bore into the tubing string, but prevents reverse flow downward through the standing valve from the tubing string into the well bore.

Fluid from the well bore flows upward through the conventional standing valve by displacing the ball from the valve seat. The fluid is thereafter retained in the tubing string as the weight of the accumulated fluid imparts a downward seating force on the ball against the valve seat. A generally recognized problem in the industry, however, is that often more fluid will accumulate above the standing valve than can be purged by the gas-lift method. Although the process variables affecting the intermittent purge cycles can be adjusted, the wells are for the most part are unattended. Effective control of the accumulated fluid head, therefore, requires anticipating the accumulation rate of fluids between purge cycles.

The frequency of purge cycles is desirably held to a minimum because excessive purge frequency results in a greater likelihood of premature tubing string failure or of lodged plungers within the tubing string. Changes in either bottom-hole pressure or fluid flow rate are likely to create an unanticipated accumulation of fluid in the tubing string that is heavier than the purging capability of the gas-lift method. It is also common for a mechanical failure to prevent fill or proper purging, such as a choke valve or controller failure. A purge failure with a conventional standing valve will result in the continual accumulation of fluid head until eventually the head pressure of the accumulated fluid shuts the gas flow in below the head.

Upon discovering a purge failure, the well operator is usually faced with only one recuperative option, that of "swabbing" the well to remove the accumulated fluid. This process of swabbing the well entails costly down time and service work.

Thus, despite these and other advances in the art, there is a need in the industry for a solution to the problem of purge failure in gas-lift methods of production. The present invention provides a device for effectively regulating the amount of fluid which accumulates in the tubing string so that the fluid can be reliably purged when using gas-lift methods. The present invention enhances the efficiency of gas-lift production, eliminates the need for swabbing, and offers other advantages over the prior art which will be recognized by those skilled in the art.

SUMMARY OF THE INVENTION

The present invention provides an improved standing valve that regulates the amount of accumulated fluid head in the tubing string of an oil and gas well using a gas-lift method to enhance production. The present invention uses a hydrostatic standing valve with a floating valve seat which is displaced in response to the weight of the accumulated fluid head. A ball seals an annulus in the floating valve seat and floats with it, but the displacement of the ball is limited by a positive stop provided by a rod supported by the standing valve body. When the valve seat displaces beyond the displacement of the ball, as limited by the positive stop, the ball is disengaged from the valve seat and annulus is opened, allowing fluid flow out of the tubing string. The dynamic response of the valve seat to the weight of the fluid head regulates the accumulated fluid head so that it does not exceed a predetermined amount. Regulation of the fluid head provides a predictable weight of fluid that can be reliably purged by the gas-lift method. The present invention may be used with either a continuous or an intermittent gas-lift methodology, and may furthermore be used with a lifting plunger in an intermittent gas-lift method. By limiting the fluid head in the tubing string, the well can operate continuously for longer periods between intermittent fluid purges because the fluid head through which gas must channel to be produced is regulated at or below a predetermined maximum amount, beyond which continued production is not economically feasible.

The foregoing is considered as illustrative only of the principles of the invention. Further, since numerous modifications and changes will readily occur to those skilled in the art it is not desired to limit the invention to the exact construction and operation shown and described. Accordingly, all suitable modifications and equivalents may be resorted to as they fall within the scope of the invention.

DETAILED DESCRIPTION

Figure 1:
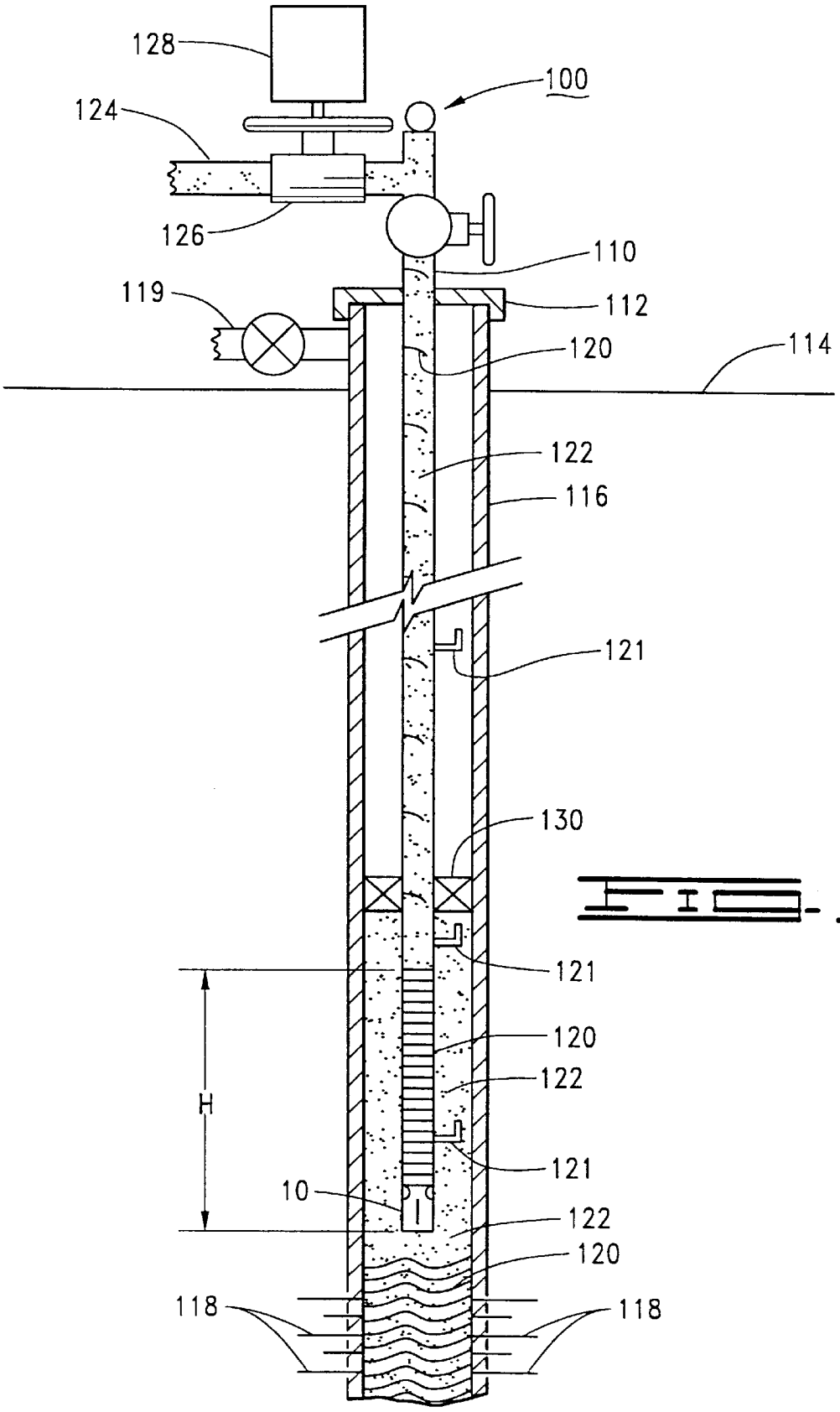
FIG. 1 is a diagrammatic view of an improved oil and gas well having a standing valve that is constructed in accordance with the present invention.

Referring now to FIG. 1, shown therein is an oil and gas well 100 in which the present invention is particularly useful. FIG. 1 shows a well 100 having a tubing string 110 that passes through a well head 112. The tubing string 110 is enclosed below the earth's surface 114 within a casing 116 that is inserted in the well bore (not shown). The casing 116 has a plurality of perforations 118 at a selected depth within the subterranean formation (not shown). Fluid comprising liquid 120 and gas 122 flows from the subterranean formation into the casing 116 by passing through the perforations 118.

Above the earth's surface 114, a production line 124 delivers the fluid produced through the tubing string 110 to a separator (not shown). A choke valve 126 variably restricts the fluid flow rate to provide a desirable back pressure in the tubing string 110. The choke valve 126 is controlled by a conventional controller 128, which may be responsive to a number of well conditions, such as subterranean formation and casing pressures. A conventional packer 130 may be positioned in a well known manner to finally deplete a well, or where a leak in the casing 116 must be isolated.

The well 100 of FIG. 1 is a continuously flowing type of well, and is aided by a gas-lift method. The gas-lift method involves the injection of high pressure gas, such as air, through a casing line 119 into the casing 116. A plurality of conventional pressure-control valves 121 are arranged on the tubing string 110 in a manner well known in the art so that the uncovered valves inject the gas-lift pressure into the tubing string. This aerates and lightens the fluid column to facilitate the removal of the fluid through the tubing string 110.

Alternatively, the well 100 may use an intermittent gas-lift method. The intermittent gas-lift method is performed by periodically closing the choke valve 126 to build a pressure differential across a slug of fluid in the tubing string 110. The pressure build-up may come from the formation pressure, or it may be supplementally injected into the casing 116. One skilled in the art will recognize that in the latter method the control valves 121 would likely not be used so that the entire gas-lift pressure is injected at the bottom of the tubing string 110, upstream of the fluid slug. Furthermore, the present invention is useful in a well 100 using an intermittent gas-lift method in conjunction with a common lifting plunger to provide a mechanical seal between the lifting gas and the fluid being purged.

Figure 2:
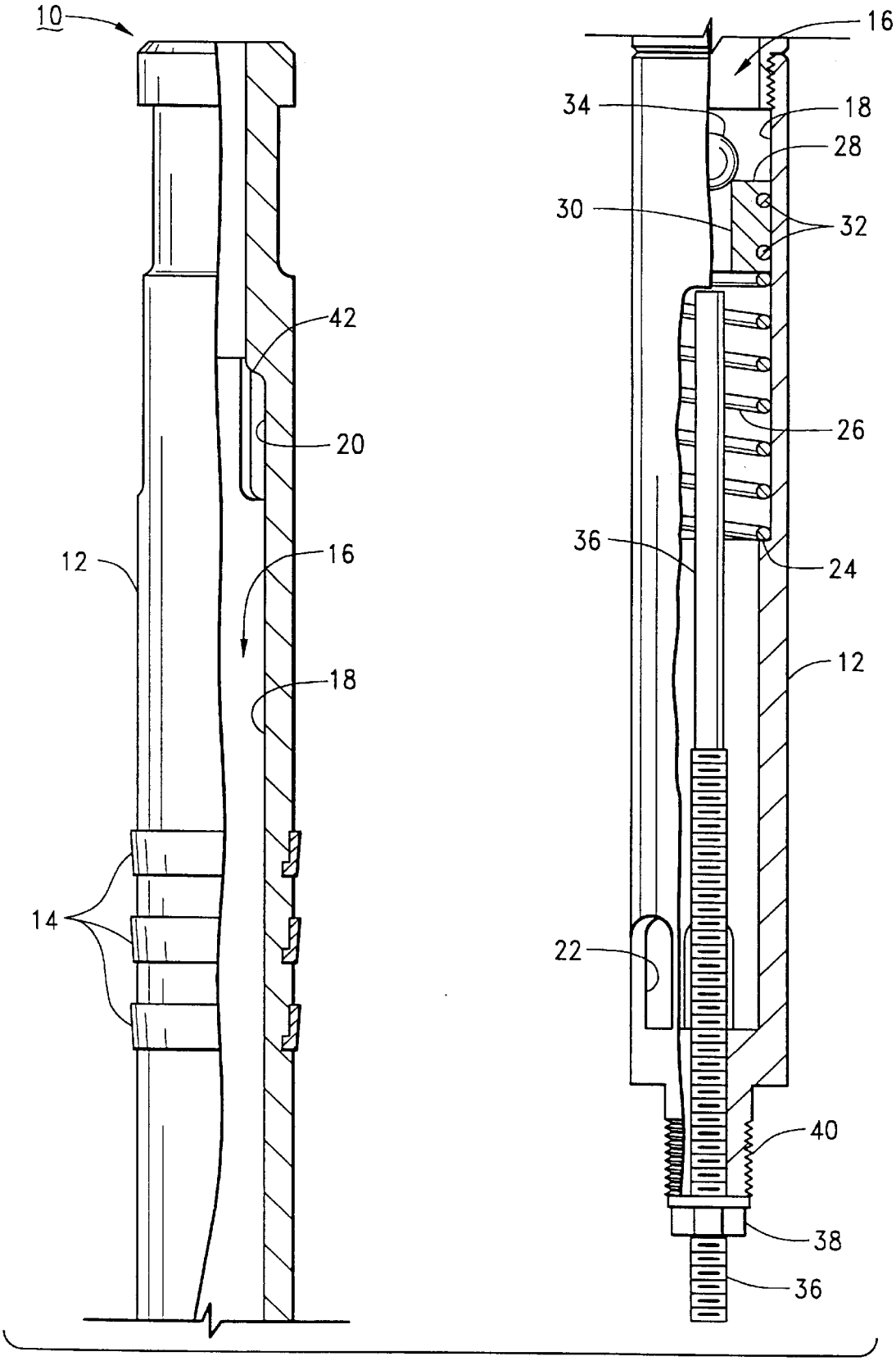
FIG. 2 is a partial sectional view of a hydrostatic standing valve of the present invention, illustrating a first mode where the fluid head in the tubing string is less than a predetermined amount.

Positioned in the lower end of the tubing string 110 is a preferred embodiment of a standing valve 10 constructed in accordance with the present invention. The standing valve 10 of the present invention provides a means for regulating the accumulated fluid head in the tubing string 110. In the preferred embodiment as shown in FIG. 2, the standing valve 10 includes a body 12 which supports a plurality of packing cups 14 for conventional seating of the standing valve 10 in the tubing string 110, such as in a conventional seating nipple (not shown). The body 12 has a central passageway 16 which is defined by an inner wall 18 of the body 12, and also has a plurality of upper and lower openings 20, 22 through the body 12. The central passageway 16 and the upper and lower openings 20, 22 communicate to provide fluid passage through the standing valve 10. The inner wall 18 of the body 12 includes a shoulder 24 which supports a compressible member, such as a spring 26, within the central passageway 16. A valve seat 28 is slidably disposed within the central passageway 16 and is supported by the top end of the spring 26. The position of the valve seat 28 within the central passageway 16 is determined by the degree of compression of spring 26. The valve seat 28 includes an annulus 30 which preferably has a central axis that is coaxial with the axis of the central passageway 16. A fluid-tight seal is maintained between the valve seat 28 and the inner wall 18 of the central passageway 16 by o-ring seals 32 supported within grooves on the valve seat 28, as shown.

Figure 3:
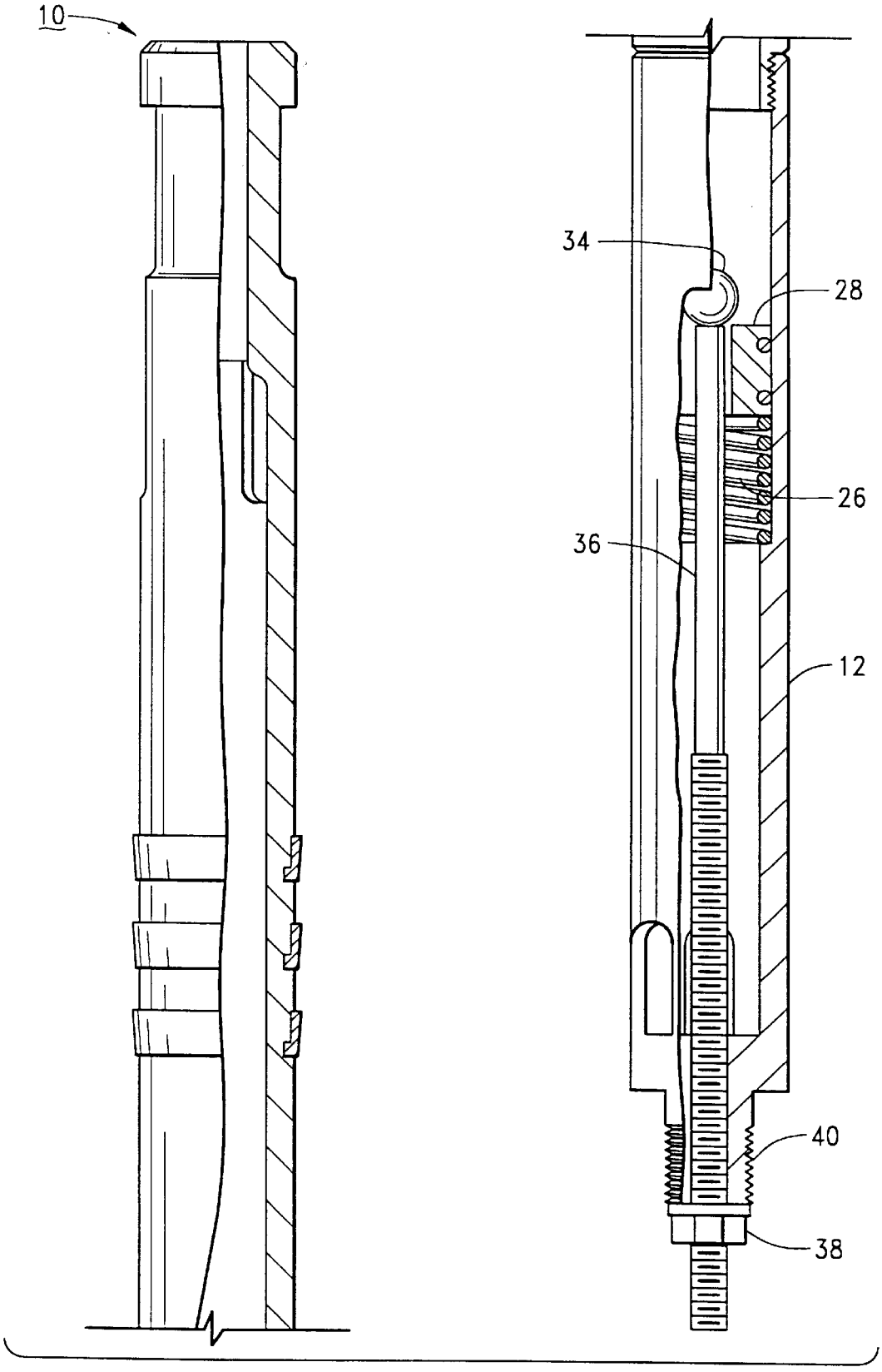
FIG. 3 is a partial sectional view of the hydrostatic standing valve of FIG. 2, illustrating a second mode where the accumulated fluid head in the tubing string is greater than a predetermined amount.

A valve ball 34 is disposed within the central passageway 16 and is appropriately sized so that it will not escape through annulus 30 or upper opening 20 and so that it will provide a sealing engagement with the valve seat 28, as necessary to close the annulus 30. A rod 36 is threadably disposed through a threaded aperture in the lower end of the body 12. The rod 36 provides a limit to the downward displacement of the ball 34. Rotation of the rod 36 thereby threadably advances the upper end of the rod 36. A locking nut 38 threadably engages the rod 36 and pressingly engages a shoulder portion 40 of the body 12 to lockingly secure the rod 36 at a selected adjustment. Preferably, the rod 36 has an axis coaxial with the annulus 30 and is appropriately sized so that the rod 36 does not impede the downward displacement of the valve seat 28 when the spring 26 is compressed, as shown in FIG. 3. In the preferred embodiment illustrated by FIG. 3, displacement of the valve seat 28 is limited only by full compression of the spring 26. Alternatively, downward displacement of the valve seat 28 could be limited by a protruding shoulder (not shown) formed on the rod 36.

As shown in FIG. 3, the position of the upper end of rod 36 is adjusted so that when the spring 26 is compressed a predetermined amount, the upper end of the rod 36 engages the ball 34 to unseat the ball 34 from the valve seat 28. The unseating of the ball 34 allows fluid to pass through the annulus 30 of the valve seat 28, enabling fluid to flow downward from the tubing string 110 through the standing valve 10 into the well bore.

When the downward fluid pressure above the annulus 30 is greater than the upward fluid pressure below the annulus 30, the ball 34 is supported by the valve seat 28, as is illustrated in FIG. 2, and sealingly engages against the valve seat 28, thereby preventing downward flow of fluid through the annulus 30. When the upward pressure below the annulus 30 is greater than the downward pressure above the annulus 30, the ball 34 disengages from the valve seat 28 and is lifted upwardly by the force of the fluid flowing through the central passageway. The upward displacement of the ball 34 is limited by a stop 42 above the upper openings 20. One skilled in the art will recognize the check valve function of this aspect of the standing valve 10, which is similar in some respects to the conventional standing valve described above which permits fluid flow upward through the standing valve 10, but prevents reverse flow downward through the standing valve 10 back into the well bore.

The present invention, however, has the ability to hydrostatically regulate the amount of fluid in the tubing string 110. As fluid accumulates in the tubing string 110 above the standing valve 10 constructed in accordance with the present invention, its weight imparts a downward force on the valve seat 28 and ball 34. When the weight of the fluid exceeds the opposing force of the spring 26, the spring 26 compresses and the valve seat 28 displaces downwardly. When the valve seat 28 is displaced a preselected distance, the upper end of the rod 36 engages the ball 34, unseating the ball 34 from the valve seat 28 and allowing fluid to flow through the annulus 30 from the tubing string 110 into the well bore. As fluid flows through the annulus 30, the amount of accumulated fluid decreases until it reaches an amount less than the predetermined amount, where the weight of the fluid is once again less than the spring 26 force. When the spring 26 force exceeds the weight of the fluid, the spring 26 decompresses and displaces the valve seat 28 upwardly into sealing engagement against the ball 34 to prevent further fluid flow downwardly through the annulus 30.

As fluid enters the tubing string 110 and is returned to the well bore through the standing valve 10 in this manner, the accumulated amount of fluid in the tubing string 110 is regulated below a predetermined amount. This results in an accumulated amount of fluid of a predictable weight which can be reliably purged by the gas-lift method.

The standing valve 10 is adjustable to open the annulus 30 thereof at a selected hydrostatic pressure. For a spring of a known stiffness, the displacement of the valve seat 28 is directly proportional to the weight of the maximum desired head, and inversely proportional to the spring constant. The calculated displacement of the valve seat 28 in response to the desired maximum head determines the offset between the upper end of the rod 36 and the ball 34 when the spring 26 is unloaded.

One skilled in the art will understand that a well 100 of the present invention flowing continuously will automatically regulate a maximum fluid head above the standing valve 10 of the present invention. The maximum desired head, denoted as H in FIG. 1, is automatically regulated so as not to exceed the gas-lift method capability, whether continuous or intermittent. Although not shown in FIG. 1, one skilled in the art will recognize that the standing valve of the present invention is likewise useful in an oil and gas well 100 using a gas-lift method in conjunction with a lifting plunger.

A further benefit of the present invention is that the well 100 can continuously produce for longer periods of time between purging cycles. This is due to the dual storage of fluid both in the tubing string 110 and in the well bore. The predetermined fluid head in the tubing string 110 can be selected to provide a head pressure that is not significantly adverse to the fluid production from the subterranean formation. Accumulated fluid beyond the predetermined amount flows back to the well bore, which will usually accept a certain amount without adversely affecting the fluid production. By splitting the accumulated fluid, and regulating the head in the tubing string 110, the opposing force of the accumulated fluid against the production pressure is minimized, allowing longer continuous production between purging cycles.

From the previous description in conjunction with the appended drawings, it will be understood that the present invention provides an improved standing valve that regulates the amount of accumulated fluid head in the tubing string of an oil and gas well. The standing valve of the present invention includes a floating valve seat which is displaced in response to the weight of the accumulated fluid head. A ball seals against the floating valve seat and floats with it, but the displacement of the ball is limited by a positive stop provided by a rod supported by the body of the standing valve. When the valve seat displaces beyond the displacement of the ball, as limited by the positive stop, the ball is dis-engaged from the valve seat and the annulus in the valve seat is opened allowing fluid flow out of the tubing string. The dynamic response of the valve seat to the weight of the fluid head regulates the accumulated fluid head so that it does not exceed a predetermined amount. Regulation of the fluid head provides a predictable weight of fluid that can reliably be purged by the gas-lift method. It will be further noted that by limiting the fluid head in the tubing string, the well can operate continuously for longer periods between intermittent fluid purges because the fluid head through which gas must channel to be produced is regulated at or below a predetermined maximum amount, beyond which continued production is not economically feasible.

It is clear that the present invention is well adapted to attain the ends and advantages mentioned as well as those inherent therein. While a presently preferred embodiment of the invention has been described for purposes of the disclosure, it will be understood that numerous changes may be made which will readily suggest themselves to those skilled in the art and which are encompassed within the spirit of the invention disclosed and as defined in the appended claims.

What is claimed is:

1. An improved oil and gas well having a tubing string that is partially enclosed within a casing which lines a well bore, the tubing string having an upper end above the casing and a distal end that is disposed within a subterranean oil and gas formation so that fluid can be produced from the subterranean formation through the tubing string to the upper end, wherein the improvement comprises:

a hydrostatic standing valve disposed near the distal end of the tubing string that regulates the amount of fluid capable of accumulating in the tubing string.

2. The oil and gas well of claim 1 wherein the hydrostatic standing valve further comprises:

a body having a central passageway;

a compressible member disposed within the central passageway; and a valve seat supported by the compressible member and slidingly disposed within the central passageway.

3. The oil and gas well of claim 2 wherein the hydrostatic standing valve further comprises:

a ball which sealingly engages the valve seat to close the central passageway to downward flow of fluid.

4. The oil and gas well of claim 3 wherein the accumulation of a predetermined amount of fluid in the well imparts a compression to the compressible member, wherein the valve seat and ball are displaced in response to the compression of the compressible member, and wherein a positive stop limits the displacement of the ball and thereby sealingly disengages the ball from the valve seat, to open the central passageway to downward flow of fluid out of the tubing string.

5. The oil and gas well of claim 4 wherein the positive stop comprises a rod having first and second ends, wherein the first end is supported by the hydrostatic standing valve body, and wherein the second end pressingly engages the ball when compression of the compressible member displaces the valve seat more than a predetermined amount.

6. The oil and gas well of claim 5 wherein the hydrostatic standing valve body has a threaded aperture and wherein the first end of the rod has a threaded portion which threadingly engages the threaded aperture of the hydrostatic standing valve body, so that the second end of the rod is adjustably positionable within the central passageway, and wherein a locking nut threadingly engages the first end of the rod and pressingly engages the hydrostatic standing valve body to lock the rod in a selected position.

7. The oil and gas well of claim 2 wherein the compressible member comprises a spring.

8. The oil and gas well of claim 1 further comprising:

a lifting plunger slidably disposed within the tubing string which rises and falls within the tubing string; and a bumper spring supported by the hydrostatic standing valve to cushion the impact of the plunger against the standing valve as the plunger falls within the tubing string.

9. A standing valve for regulating the amount of fluid in a tubing string of an oil and gas well comprising:

a body having a lower opening, an upper opening, and a passageway connecting the upper and lower openings; and a means for regulating the amount of fluid which accumulates above the standing valve.

10. The standing valve of claim 9 wherein the means for regulating further comprises:

a compressible member disposed within the passageway, wherein the compressible member has a lower end and an upper end.

11. The standing valve of claim 9 wherein the means for regulating further comprises:

a valve seat slidably disposed within the passageway, the valve seat forming an annulus in fluid communication with the passageway; and a ball supported by the valve seat which sealingly engages the annulus when the accumulated fluid is less than a predetermined amount to prevent fluid from flowing out of the tubing string.

12. The standing valve of claim 11 wherein the means for regulating further comprises:

a positive stop comprising a rod having a proximal first end supported by the body, and having a distal end coaxially aligned with the annulus passageway;

wherein the rod distal end pressingly engages the ball and disengages the ball from the annulus to permit a flow of fluid out of the tubing string when the fluid accumulated in the tubing string is greater than or equal to the predetermined amount.

13. A standing valve for regulating the amount of accumulated fluid in a tubing string of an oil and gas well, which comprises:

a body having a lower opening, an upper opening, and a passageway connecting the upper and lower openings;

a compressible member disposed within the passageway, wherein the compressible member has a lower end and an upper end;

a valve seat disposed within the passageway of the body above the upper end of the compressible member, the valve seat having an annulus;

a ball disposed within the passageway of the body above the valve seat;

a rod disposed within the passageway of the body, the rod having an axis which is substantially coaxially aligned with the annulus of the valve seat;

wherein the ball rests on the valve seat to close the annulus of the valve seat to a flow of fluid out of the tubing string when the accumulated fluid is below a predetermined amount; and wherein the rod engages the ball when the accumulated fluid is greater than or equal to a predetermined amount, to open the annulus of the valve seat to a flow of fluid out of the tubing string.

14. The standing valve of claim 13 wherein the compressible member comprises a spring.

15. The standing valve of claim 13 wherein the rod position is adjustable to vary the amount of predetermined fluid that causes the rod to engage the ball.

16. A standing valve for regulating the amount of fluid in a tubing string of an oil and gas well comprising:

a body having a lower opening, an upper opening, and a passageway connecting the upper and lower openings; and a means for regulating the amount of fluid which accumulates above the standing valve, comprising:

a valve seat slidably disposed within the passageway, the valve seat forming an annulus in fluid communication with the passageway;

a ball supported by the valve seat which sealingly engages the annulus when the accumulated fluid is less than a predetermined amount to prevent fluid from flowing out of the tubing string;

a positive stop comprising a rod having a proximal first end supported by the body, and having a distal end coaxially aligned with the annular passageway; and wherein the rod distal end pressingly engages the ball and disengages the ball from the annulus to permit a flow of fluid out of the tubing string when the fluid accumulated in the tubing string is greater than or equal to the predetermined amount.

* * * * *